US006497787B1

(12) United States Patent
Geel

(10) Patent No.: US 6,497,787 B1
(45) Date of Patent: Dec. 24, 2002

(54) PROCESS OF MANUFACTURING A WET-LAID VEIL

(75) Inventor: Paul Adriaan Geel, Doorwerth (NL)

(73) Assignee: Owens-Corning Veil Netherlands B.V., Apeldoorn (NL)

( * ) Notice: Subject to any disclaimer, the term of this patent is extended or adjusted under 35 U.S.C. 154(b) by 0 days.

(21) Appl. No.: 09/552,031

(22) Filed: Apr. 18, 2000

(51) Int. Cl.[7] ..... D21H 23/00; D21H 25/04; D21H 21/18

(52) U.S. Cl. ..... 162/158; 162/152; 162/156; 162/169; 162/100; 162/183; 162/135; 162/157.1

(58) Field of Search ..... 162/145–146, 162/131, 133, 123, 152, 156–157.1, 157.3, 169, 157.6, 175.7, 100, 158, 183, 160, 184, 164.1, 168.1, 135; 264/45.1–45.4; 428/299.1, 299.4, 299.7, 300.1, 300.4, 300.7

(56) References Cited

U.S. PATENT DOCUMENTS 3,510,394 A * 5/1970 Cadotte ..... 162/145
3,573,158 A * 3/1971 Pall et al. ..... 162/131
3,622,445 A * 11/1971 Heidweiller ..... 162/145
3,676,288 A 7/1972 Hoyle
4,471,018 A 9/1984 Kritchevsky et al.
4,747,346 A 5/1988 Geel
4,818,583 A 4/1989 Geel
4,946,737 A 8/1990 Lindeman et al.
5,132,061 A 7/1992 Lindeman et al.
5,360,826 A 11/1994 Egolf et al.
5,422,055 A 6/1995 Yalvac et al.
5,607,550 A * 3/1997 Akers ..... 162/102
5,695,871 A 12/1997 Tallentire et al.
5,795,439 A * 8/1998 Euripides et al. ..... 162/100
5,997,690 A * 12/1999 Woodrum ..... 162/100
6,056,854 A * 5/2000 Woodrum ..... 162/141
6,120,643 A * 9/2000 Levit ..... 162/141
6,290,813 B1 * 9/2001 Woodrum ..... 162/158

FOREIGN PATENT DOCUMENTS

EP 0 486 080 A2 5/1992

* cited by examiner

*Primary Examiner*—Jose A. Fortuna
(74) *Attorney, Agent, or Firm*—Inger H. Eckert; Stephen W. Barns

(57) ABSTRACT

A method of making a microsphere-filled wet-laid veil involves forming a non-woven fibrous veil, contacting the veil with an impregnation binder composition having a binder and microspheres, and impregnating the microspheres of the impregnation binder composition into the veil to form a microsphere-filled wet-laid veil. The microsphere-filled wet-laid veils produced according to the method of the present invention are useful to make molded composite articles.

14 Claims, 8 Drawing Sheets

PROCESS OF MANUFACTURING A WET-LAID VEIL

TECHNICAL FIELD AND INDUSTRIAL APPLICABILITY OF THE INVENTION

The present invention relates to a process of manufacturing a wet laid fibrous veil suitable for the preparation of reinforced articles. The wet laid fibrous veils comprise microspheres, which improve the rigidity or impact resistance of the reinforced articles and particularly, lightweight articles.

BACKGROUND OF THE INVENTION

Microspheres have been incorporated into fibrous nonwoven reinforcements, which are useful in the production of molded composite articles to provide for the formation of lightweight composites. It has been found that the use of expanded microspheres results in a considerable savings of resin and glass fiber in dry-laid fibrous webs. Additionally, the mechanical properties of the product reinforced with the web, such as rigidity or impact resistance, are at least maintained, or even improved, and the thermal insulation capacity is enhanced.

For example, UK Patent No. 1,427,647 and U.S. Pat. No. 3,676,288 describe the application to, or incorporation of non-expanded microspheres into a fibrous web using a binder, such as a polyacrylonitrile latex. As the binder resin is dried and cross-linked, the microspheres are attached to the fibrous web and expanded. In U.S. Pat. No. 4,818,583, a method of manufacturing a bonded fibrous web comprising microspheres were described. However, these methods of adding the microspheres to the fibrous web were directed to a dry-laid process.

Fibrous webs or veils, which are one form of fibrous nonwoven reinforcements, are extremely suitable as reinforcements for many kinds of cured synthetic plastic materials, such as polyester or epoxy resin. Fibrous veils are typically made by a dry or wet-laid process. Typically, glass and mineral fibers have been integrated into the fibrous veils to provide added strength and durability to the composite article made by molding the veil. However, the use of glass fibers in a dry-laid process wears out the machines typically involved in the dry-laid process. Accordingly, integrating glass fibers in a dry-laid process may be costly.

There is a thus a need for a wet-laid process of making fibrous veils that can be used as a reinforcement in composite molding, which allows for the cost-effective incorporation of glass or other reinforcement and allows for the incorporation of microspheres for added rigidity and impact resistance. Furthermore, there is a need to obtain a continuous and efficient method of producing such fibrous reinforcements.

SUMMARY OF THE INVENTION

A method of making a microsphere-filled wet-laid veil is disclosed. In one embodiment, the method comprises forming a non-woven fibrous veil, and impregnating microspheres into the veil to form a microsphere-filled wet-laid veil. Preferably, the step of impregnating microspheres into the veil is achieved by contacting the veil with an impregnation binder composition comprising a binder and the microspheres. In a preferred embodiment, the method comprises forming a pre-bonded veil of glass fibers without microspheres. Subsequently, the pre-bonded veil is impregnated inline with a binder composition comprising a binder and microspheres, then the microspheres are expanded.

The invention further comprises microsphere-filled wet-laid veils produced according to the above-mentioned method. Moreover, the invention comprises molded composite articles made using the wet-laid veils manufactured according to the present invention.

DETAILED DESCRIPTION OF THE PREFERRED EMBODIMENTS OF THE INVENTION

Figure 1A:
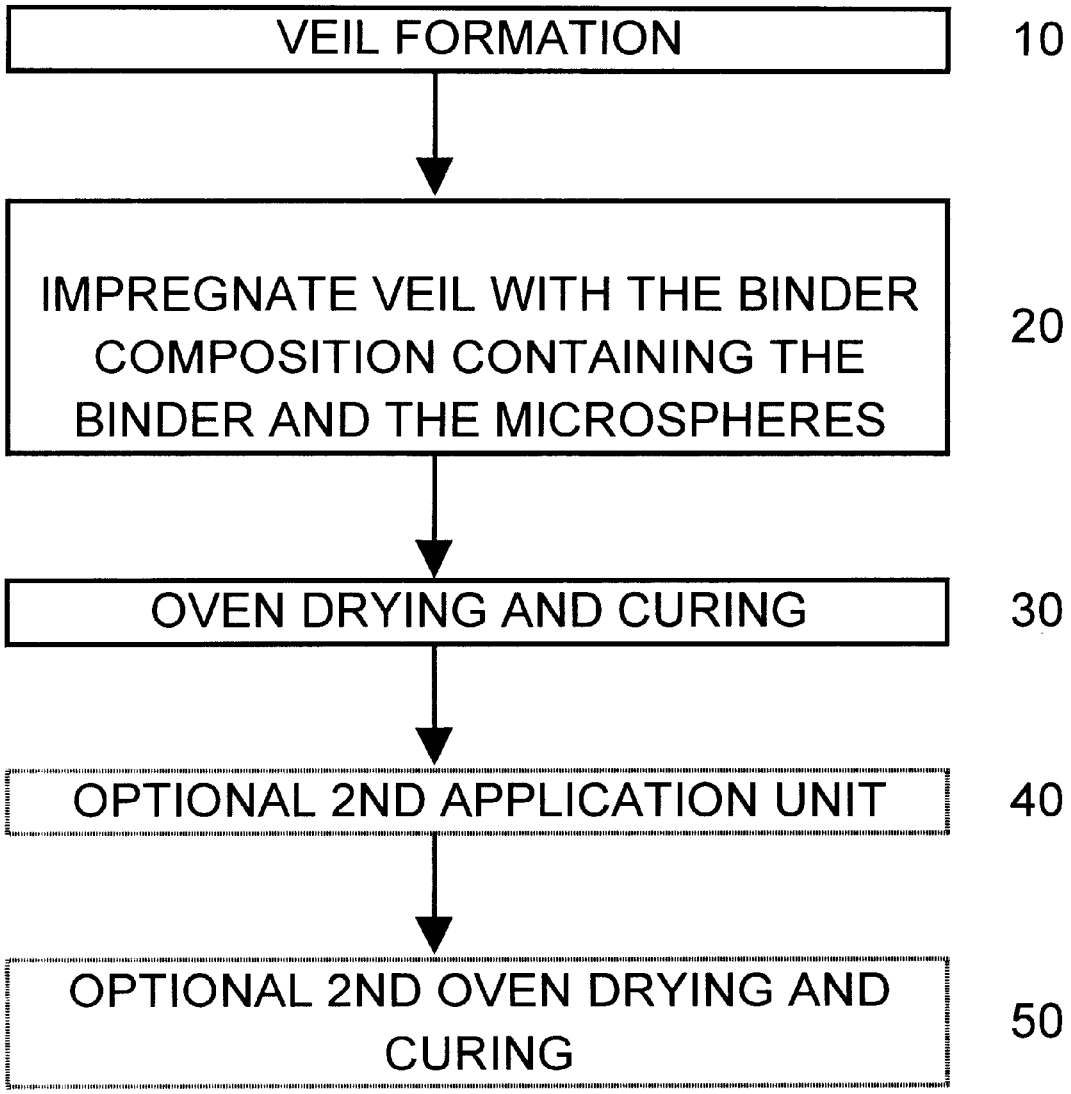
FIGS. 1A, 1B, and 1C are flow diagrams of three embodiments of the process of the present invention.

The present invention relates to a process of manufacturing a wet-laid nonwoven fibrous veil comprising microspheres. As shown in FIG. 1A, the process involves making a non-woven wet-laid fibrous veil 10 and impregnating microspheres into the veil 20.

The term, "wet-laid veil," as used herein, refers to a web of intermingled, randomly oriented reinforcing fibers made according to a wet laid process. The "veil" of the present invention may also include "sheets" or "mats" made in accordance with the wet-laid process. The fibers are preferably segmented and optionally, the formed veil may be reinforced with continuous filaments.

Figure 1B:
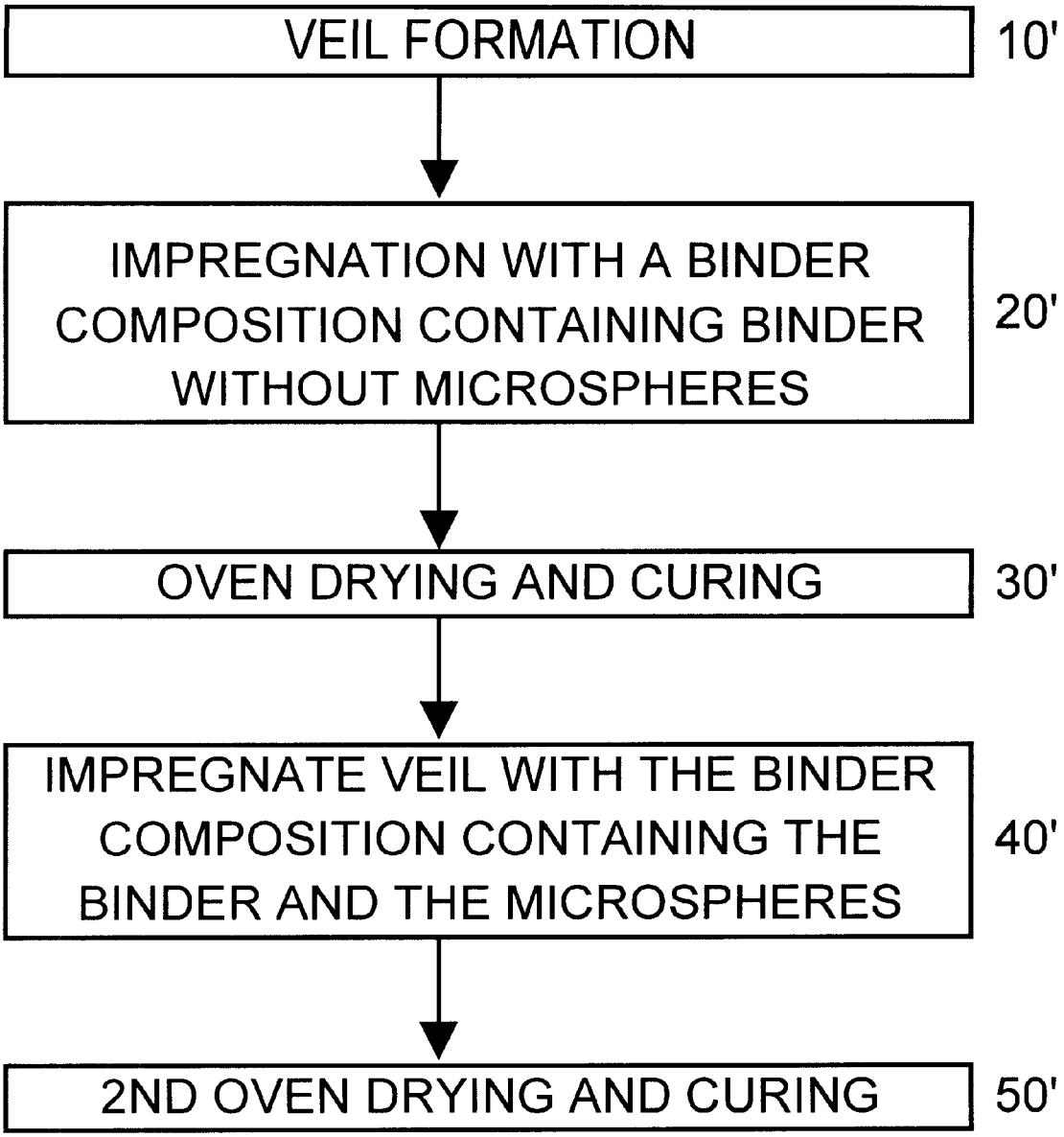
Figure 1C:
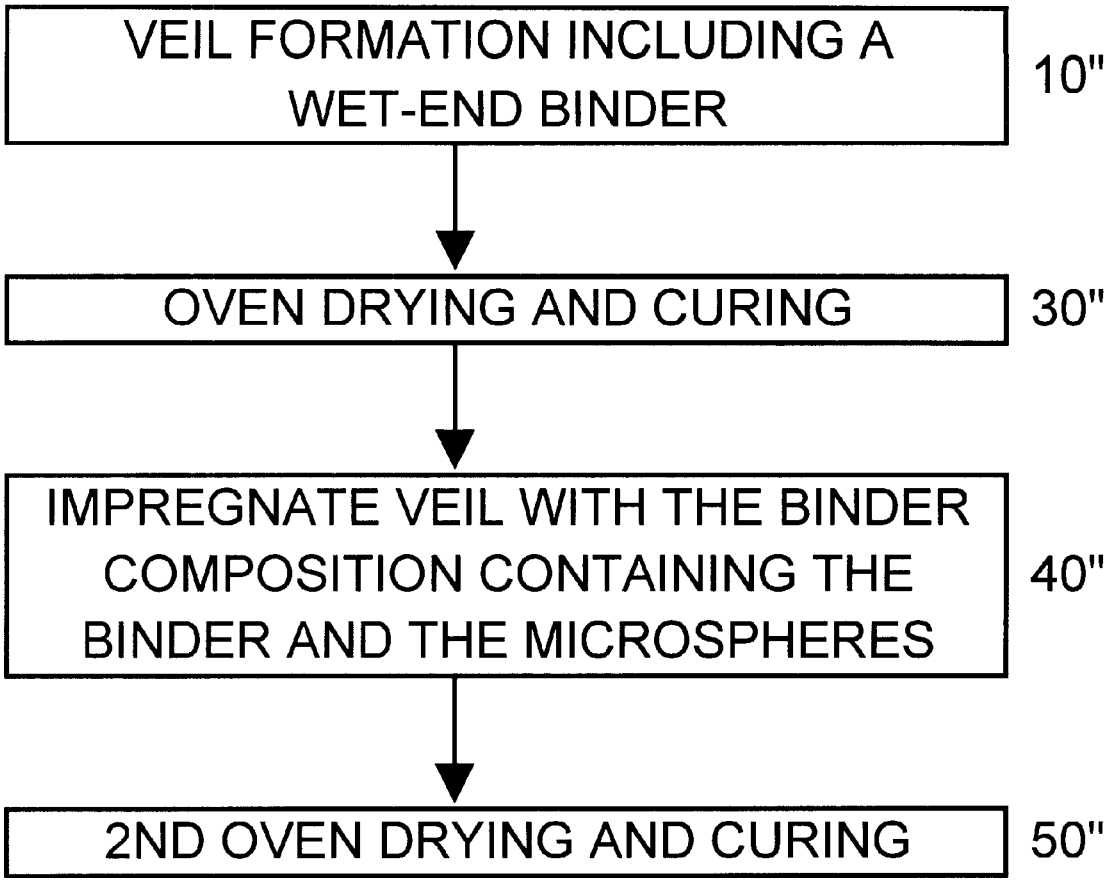

"Impregnating," as used herein, refers to a means of integrating microspheres into the fibrous veil. The method of impregnating may be conducted by any method suitable for integrating or incorporating these materials into the fibrous veil. In accordance with the present invention, the microspheres are impregnated into the veil at any time after formation of the veil. In particular, the microspheres are preferably impregnated after formation in a formation chamber, such as on a wire, or after being passed through a first dryer. As shown in FIGS. 1B and 1C, most preferably, the microspheres are impregnated, see steps 40' and 40", after being passed through a first dryer 30', 30".

The "microspheres" of the present invention are particles of thermoplastic resin material, which may have incorporated therein a chemical or physical blowing agent, and which may be expanded upon heating. The microspheres of the present invention can have any desired diameter. For example, they may have a diameter of about 6 to about 45 microns, preferably, about 10 to about 16 microns, in an unexpanded state, and a diameter of about 15 to about 90 microns, preferably about 40 to about 60 microns in an expanded state. The microspheres may be used in either its expanded or unexpanded state. Any suitable thermoplastic resin material may be used to make up the microspheres. Suitable thermoplastic resin materials include, for example, polystyrene, styrene copolymers, acrylonitrile, polyvinyl chloride, vinyl chloride copolymers, vinylidene chloride copolymers, and the like. The thermoplastic synthetic resin material is preferably solid at room temperature. Preferably, the microsphere is comprised of the thermoplastic resin material, vinylidene chloride copolymer.

Preferably, the microspheres include a chemical or physical blowing agent within the sphere that permits them to be expanded upon heating. Any suitable blowing agent may be used provided that it that causes the microspheres to expand upon heating. For example, suitable blowing agents include azodicarbonamide, isobutane, pentane, isopentane and freon. Preferably, the blowing agent is isopentane.

Figure 6:
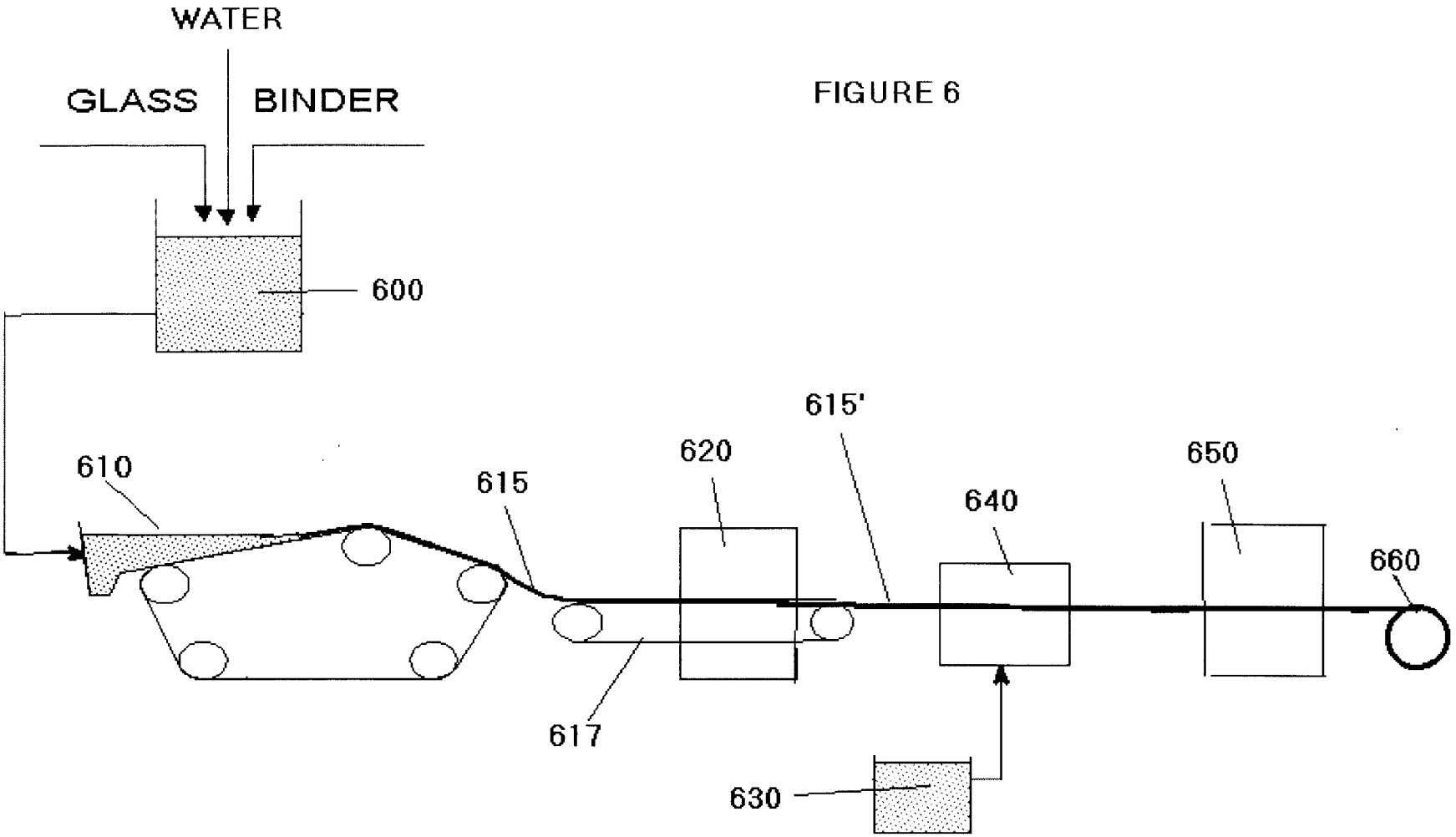
FIG. 6 is a schematic representation of the preferred embodiment of the present invention.

As shown in FIG. 6, a wet lay process comprises mixing reinforcing fiber components with water in an aqueous fiber slurry 600 under agitation in a mixing tank. The reinforcing fiber component may be any reinforcing fiber suitable for use in a wet laid process. For example, this may include metal fibers, ceramic fibers, mineral fibers, glass fibers, carbon fibers, graphite fibers, polymer fibers, such as aramid (e.g., Kevlar®), polyesters, polyacrylics, polyamides, polyacrylonitrile, natural fibers, and combinations thereof, as well as any other fibrous reinforcing materials that may conventionally be used in the manufacture of reinforced composites. Preferably, glass fibers are used. The fibers may be used as filaments or as strands of gathered filaments in chopped form. Optionally, continuous filaments can be used as length-oriented reinforcement for the veil. Most preferably, the fibers are chopped glass fibers.

Additional elements to make up the aqueous slurry may be added as is known in the art. For example, antistatic agents, coupling agents, pigments, surfactants, anti foams, colorings, fillers, and pre-binders, such as polyvinyl alcohol. Preferably, a pre-binder is used, which may be used in any form, such as a powder or fiber form.

As shown in FIG. 6, the aqueous fiber slurry 600 is transferred onto a suitable formation apparatus 610, such as a moving screen or forming wire on an inclined wire forming machine, wire cylinders, Foudrinier machines, Stevens Former, Roto Former, Inver Former, or Venti Former machines. Preferably, the formation of the veil is on an inclined wire forming machine. On the formation apparatus 610, the fibers and the additional slurry elements in the aqueous fiber slurry enmesh themselves into a freshly prepared wet laid fibrous veil 615, while excess water is separated therefrom. The dewatering step may be conducted by any known method such as by draining, vacuum, etc. The water content of the veil after dewatering and vacuum is preferably in the range of about 60 to about 85%.

After the wet laid fibrous veil 615 is formed, the wet laid fibrous veil is transferred to a transport belt 617, which carries the veil into a means 620 for substantially removing the water. The removal of the water may be conducted by known web drying methods, including the use of a rotary/thru air dryer or oven, a heated drum dryer, an infrared heating source, hot air blowers, microwave emitting source, and the like. At least one method of drying is necessary for removing the water, but a plurality of these methods may be used in combination to remove the water and dry the wet laid fibrous veil 617. The temperature of the dryer may range from about 120° C. at the start until about 210° C. at the end of the 1st drying process. The airspeed may be in the range of about 0.5 to 1 m/sec.

Optionally, as shown in FIG. 1A, a wet end pre-binder may be applied 20 to the veil prior to being transferred to the water removing means. If a pre-binder is used, it is bound to the fibers in the first dryer 30 to form a pre-bonded veil.

As shown in FIG. 6, after passing through the first dryer 620, the veil 615' is made up of a fiber composition. Preferably, the fiber composition of the veil 615' comprises glass fibers and a wet end pre-binder. Optionally, additional agents as described above are present. The fibers and optional pre-binder and other agents may be present in any desired ratio. Preferably, the fiber composition of the veil after the first dryer is comprised of about 70 to about 95% glass fibers and about 5 to about 30% wet end pre-binder. More preferably, the fiber composition of the veil is between about 90 to about 95% glass fibers and between about 5 to about 10% wet end pre-binder (powder or fiber) and the total dry substance level that is transported to the dryer is in the range of about 28 to about 32%.

Impregnating the microspheres into formed veil involves contacting an impregnation binder composition comprising the microspheres with the formed veil. The microspheres are combined with a binder resin to form an impregnation binder composition that may be contacted with the veil. One or more binder resins suitable for applications in reinforcing fibers may be used. Suitable binders include polyvinyl acetate (PVA), ethylene vinyl acetate/vinyl chloride (EVA/VC), lower alkyl acrylate polymer, styrene-butadiene rubber, acrylonitrile polymer, polyurethane, epoxy resins, polyvinyl chloride, polyvinylidene chloride, and copolymers of vinylidene chloride with other monomers, partially hydrolyzed polyvinyl acetate, polyvinyl alcohol, polyvinyl pyrrolidone, polyester resins, styrene acrylate, and the like. Optionally these binders can be functionalized with acidic groups, for example, by carboxylating with an acid. A suitable carboxylating agent is, for example, maleic anhydride. The binder may be used in any form, such as a powder, a fiber, or a liquid. Preferably, the binder is styrene-compatible or a soluble binder, such as styrene acrylate. It is further noted that the above-mentioned binders may also be suitable as a pre-binder.

The microspheres and binders in the impregnation binder may be present in any ratio. Preferably, the proportion of microspheres exceeds the proportion of the binder resin. More preferably, the ratio of microsphere to binder is in the range of 60:40 to 80:20.

The impregnation binder composition may further comprise other components suitable for reinforcing fiber materials. For example, the binder composition may optionally contain water, surfactants, foam stabilizers, thickeners, fillers, colorants, carbon black, hydrated alumina, blown silica, calcium carbonate, polymeric powders, and the like.

The impregnation binder is contacted with the fibrous veil after formation of the veil 615 itself. The formed veil may be contacted with the impregnation binder 630 either prior to being pre-bonded in a first dryer 620, or after being pre-bonded in the first dryer. Any method suitable for impregnating the binder composition comprising a binder and microspheres into the fibrous veil may be used. For example, suitable methods include using a size press 640, such as a Foulard applicator, a binder wire, rotary screen, dipping roll, spraying, coating equipment, and the like. While other additional agents or coatings may be applied, preferably, only the impregnation binder 630 is contacted with the wet-laid non-woven fibrous veil 615.

The microspheres are impregnated after formation of the veil, preferably prior to insertion into the first dryer or before being pre-bonded with a pre-binder, or after the wetlaid pre-bonded nonwoven fibrous veil is formed. Most preferably, the microspheres are added after the wet-laid pre-bonded nonwoven fibrous veil is formed. This is done during an inline additional impregnation process.

At the "wet-end" formation of the veil 615, such as on the forming wire 610, and prior to the first dryer 620, the formed veil comprises a fiber composition and water. The fiber composition is present in an amount of about 15% to about 45% by weight, preferably about 30% by weight. The fiber composition comprises preferably about 70% to about 95% fibers and about 5 to about 30% wet end pre-binder. The water is present in an amount of about 55% to about 85% by weight, preferably about 70% water.

When the microspheres are impregnated directly after formation at the wet-end and prior to the first dryer 10 (see FIG. 1A), the impregnation binder composition comprising a binder and the microspheres are contacted with the veil formed from the formation apparatus. In such case, the impregnation binder comprising the binder and microspheres are impregnated into the veil as set forth above. Preferably, a binder wire is used to impregnate the impregnation binder microspheres into the veil. Thereafter, the microsphere-impregnated veil passes through the first dryer to form a microsphere-filled nonvowen fibrous veil. Optionally, the veil may pass through a second dryer 650.

Alternatively, the microspheres may be impregnated after the first dryer (see FIGS. 1B and 1C), wherein a pre-binder is optionally bonded to the nonwoven fibrous veil to form the prebonded nonwoven fibrous veil. In this manner, after the first dryer, the wet-laid prebonded nonwoven fibrous veil is formed and consolidated. The impregnation binder may be applied preferably inline to the prebonded nonwoven fibrous veil as set forth above. In the preferred embodiment of the present invention, the impregnation binder composition comprising the binder and the microspheres are impregnated using a size press or Foulard type of applicator. It is particularly preferred that the veil be brought into the Foulard applicator to assure that the pre-bonded nonwoven veil is wetted on both sides. This may be accomplished by bringing the veil into the Foulard applicator from above in a double roll system, wherein the impregnation binder liquid is capable of coating both sides of the veil. Subsequently, the fibrous veil may optionally be dried and/or cured. Preferably, the impregnated fibrous veil is dried and cured in an oven, preferably an airfloat oven. One skilled in the art appreciates the curing oven may alternately comprise any suitable drying device, such as a rotary/thru air dryer or oven, a heated drum dryer, an infrared heating source, hot air blowers, microwave emitting source, and the like.

The most preferred embodiment is now described in greater detail with respect to FIG. 6. Therein, glass fibers, water, and a pre-binder are mixed to form the aqueous fiber slurry 600. The slurry 600 is then transferred to a forming apparatus 610, preferably a forming wire to form a veil 615 with concurrent dewatering (not shown). The formed veil is then passed on a belt through a first belt drier 620, wherein the pre-binder is bonded to the nonwoven fibrous veil to form the prebonded nonwoven fibrous veil 615'. The impregnation binder liquid 630 is then applied to the prebonded nonwoven fibrous veil in an impregnation unit 640. Preferably, the impregnation unit 640 is a Foulard applicator. It is particularly preferred that the prebonded nonwoven fibrous veil be wetted on both sides with the impregnation binder liquid 630 in the impregnation unit 640. This may be accomplished by feeding the veil into the impregnation unit 640 from above the unit and allowing the impregnation binder liquid 630 to coat both sides of the veil. Subsequently, the impregnated veil is dried in a second drier 650, which is preferably an airfloat oven. The resulting microsphere-filled wet-laid veil is collected on a winder 660.

It has been found that where the microspheres are added to the impregnation binder comprising the binder and microspheres, the drying process allows the various components, including the binder, synthetic resin, and blowing agent, to interact effectively with each other. For example, during the drying of the impregnated fibrous veil according to this embodiment, the binder is hardened and cross-linked, while, at the same temperature, the microspheres are expanded. The expanded impregnated microspheres give a greater volume of microspheres to the wet-laid fibrous veil.

The process of manufacturing the microsphere-filled wet-laid veil of the present invention may be conducted either in-line, i.e., in a continuous manner, or in individual steps. Preferably, the process is conducted in-line. Moreover, any additional process steps of treating the fibers, forming the wet-laid veil, and bonding the wet-laid veil is considered within the scope of the present invention.

The microsphere-filled wet-laid veil produced in accordance with the present invention may comprise any desired amount of microspheres, for example, about 5 to about 50% by weight, preferably about 15 to about 25% by weight microspheres.

The filling degree and the product thickness can be influenced by selecting a certain weight and pre-binder content of the pre-bonded nonwoven as well as the subsequently used amount of microspheres and binder. The "filling degree" determines how much resin will be necessary to be incorporated into a reinforcing material to fill or accommodate for interstitial openings in the reinforcement. The greater the filling degree, the less amount of resin is necessary for a reinforcement having the same thickness. It has been found that a greater filling degree is attained when the impregnation binder composition is contacted subsequent to formation of the wet-laid nonwoven pre-bonded fibrous veil.

Figure 2:
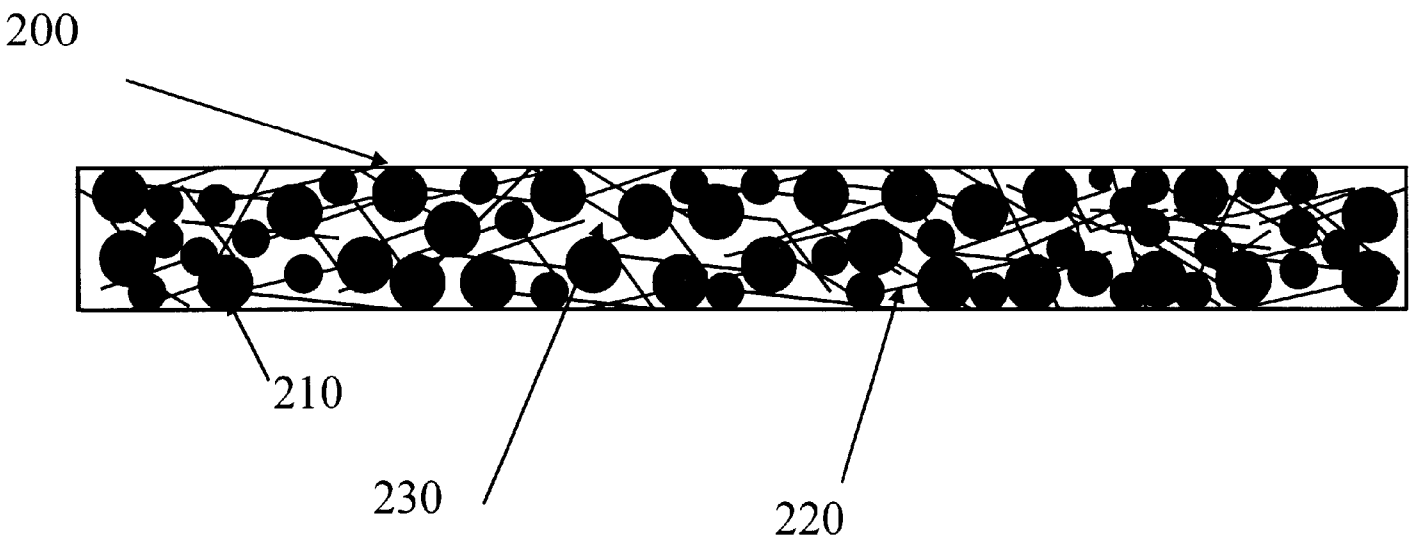
FIG. 2 is a cross-section of a microsphere-filled wet-laid veil.

Referring to FIG. 2, the microsphere-filled wet-laid veil 200 of the present invention comprise microspheres 210 and the fibers 220. The microspheres in the veil may be arranged in a regular or random pattern. The regular pattern refers to a pattern of "islands" of microspheres 210 having a substantially similar shape, separated by channels or open spaces 230 between the microspheres and the fibers 220. Alternatively, the veil may comprise a random arrangement of microspheres, which refers to an intermittently dispersed array of microspheres without any uniformity in pattern. The use of a size press or Foulard type impregnator in combination with the selected binder formulations results in a very regular dispersion of the microspheres in the veil. The uniformity of the dispersion patterns contribute to the uniform wetting of the fibers in the veils.

The veil of the present invention may subsequently be used as a reinforcement in a molding process to produce a composite article (see FIGS. 3 and 4). For example, the veil may be molded by impregnating with a liquid resin and a hardener therefor. The liquid resin may be any suitable resin for forming a reinforced fibrous material, such as polyester and epoxy resins. The hardener may be any suitable catalyst for catalyzing the cross-linking of the binder when the microsphere-filled wet-laid veil, liquid resin, and hardener are cured.

Figure 3:
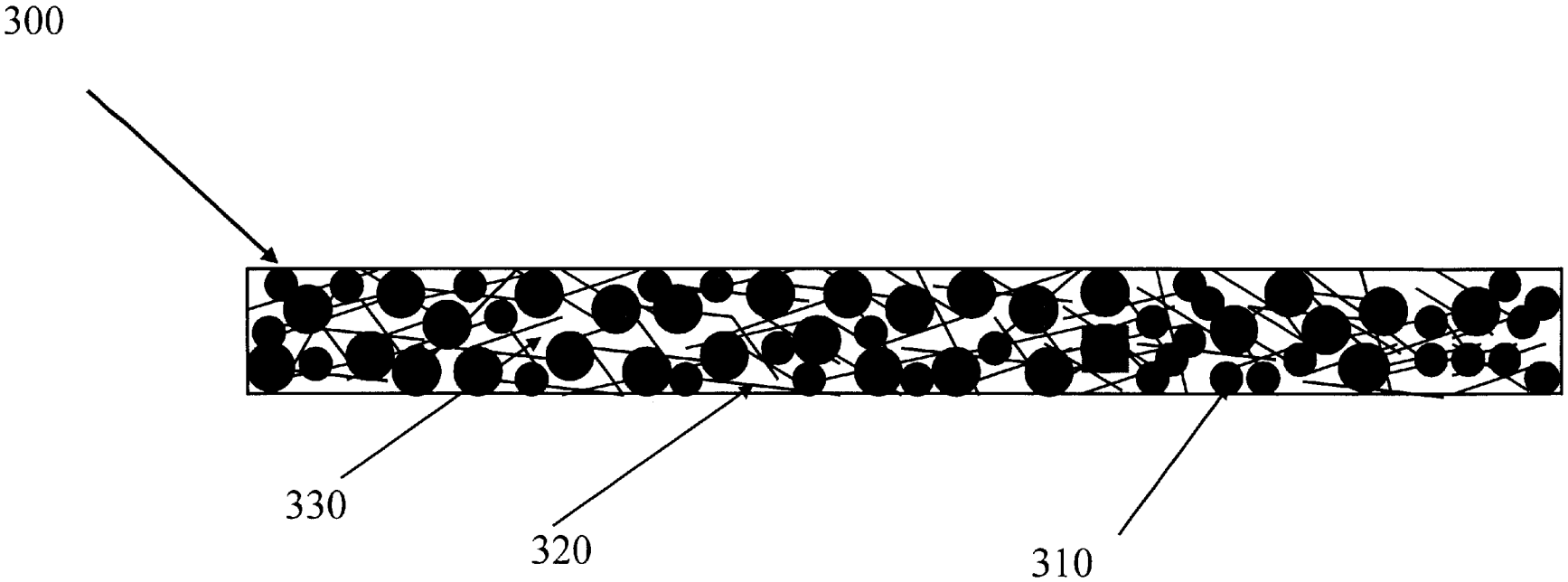
FIG. 3 is a cross-section of a microsphere-filled wet-laid veil saturated with resin.

Referring to FIG. 3, the composite article 300 reinforced with the microsphere-filled veil of the present invention comprises microspheres 310 and fiber 320 as described above. The veil is impregnated with resin 330, which is hardened and cured in the desired mold.

Figure 4:
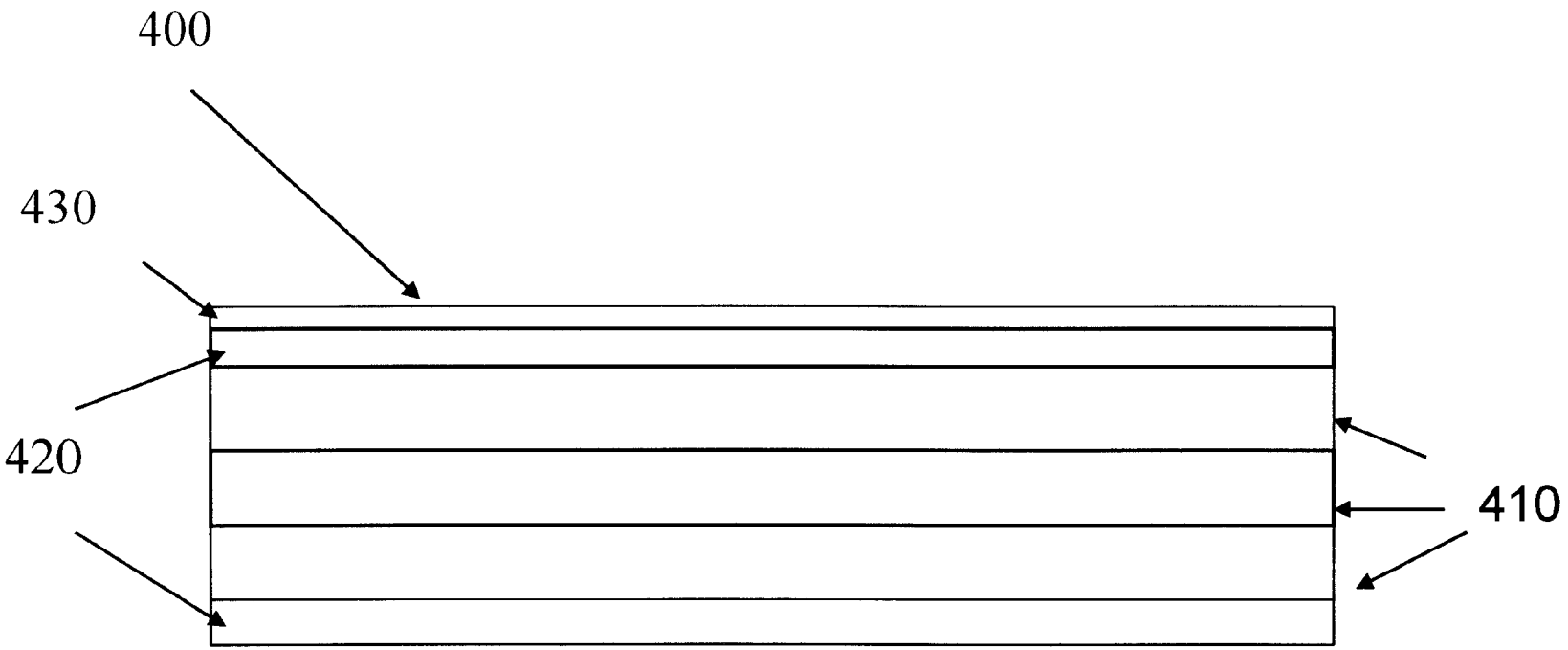
FIG. 4 is a cross-section of a laminate made with layers of microsphere-filled wet-laid veils in the core of the laminate.

Another possible embodiment of the invention is set forth in FIG. 4, wherein a laminate 400 is made using the microsphere-filled veil 410 of the present invention. In this respect, a plurality of microsphere-filled veils 410 of the present invention may be stacked between a suitable mat 420 comprising reinforcing fibers, as is known in the art. A surfacing veil 430 may further be applied to the surface of the laminate 400. The laminate is hardened and cured as known in the art. The microsphere-filled fibrous veil produced in accordance with this invention is also very suitable for use as core material for objects made of all kinds of synthetic resin such as polyester resin or epoxy resin.

Figure 5:
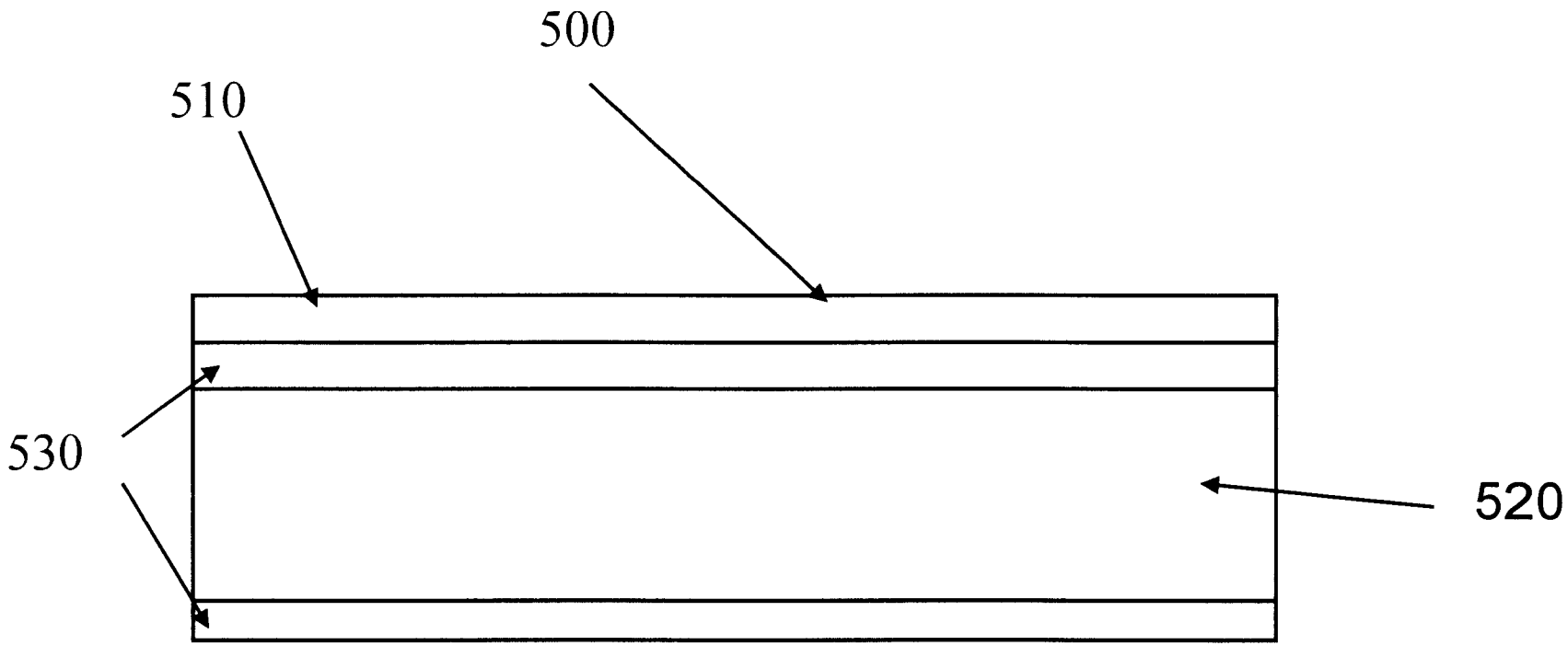
FIG. 5 is a cross-section of a laminate made with a microsphere-filled wet-laid veil as a surfacing veil.

FIG. 5 represents another application of the fibrous veil 510 produced in accordance with this invention as a surfacing veil in a laminate 500 using woven glass fabric 530 on the outside and core material 520 on the inside. In this particular application, the veils of the present invention are applied as a surfacing veil and prevents the print through from the woven fabric.

It has been found that the in-line method of manufacturing microsphere-filled wet-laid veils combines a high throughput or high production rate with a very good consistency and: significantly improved fiber distribution, as compared to dry laid technology. Moreover, the method of the present invention is advantageous over other methods due to its ease of using glass and mineral fibers. In particular, the use of glass fibers as the reinforcing fiber material is a more simple procedure than when using the dry laid process, for example. For example, whereas in a dry-laid process, the glass fibers wear out the machines required for such processes, in the wet-laid process of the present invention, no such wear is found. Accordingly, the process of the present invention is less costly and more efficient. In addition, the current use of microsphere-filled nonwovens, which are mainly made with polyester fiber, are predominantly used in GRP applications making laminates using woven glass or glass mat (e.g., chopped strand mat) on the outside and the microsphere-filled nonwoven in the core. This creates lightweight and stiff laminates. Moreover, the use of glass fibers results in a higher stiffness and strength. Furthermore, the microsphere-filled wet-laid veils also exhibit lower elongation and lower sensitivity to shrinkage, which opens the potential use in pultrusion-type processes.

The following examples are representative, but are in no way limiting as to the scope of this invention.

EXAMPLES

Example 1

A 40 grams per square meter (gsm) veil consisting of 89% 13 micron 6 mm glass and 11% PVA prebinder is formed using a wet laid process using an inclined wire former. This veil is fed to a belt dryer and dried and cured to form a prebonded sheet. The sheet is subsequently in-line-impregnated using a size press Foulard applicator with a binder/microsphere mixture consisting of 30% styrene acrylic commercially available from Necarbo as "Neboplast SBN2039" and 70% microsphere, commercially available from AKZO NOBEL as "Expancel 054WU". The binder/microsphere mixture is controlled with a vacuum system and the target set at 15 gsm. The impregnated sheet is fed to an airfloat oven to dry the sheet and expand the microsphere. Depending upon the speed, the temperature used was between about 120° C. and 180° C. With these settings, an end product thickness from about 1.2 mm and a volume filling degree from about 30% can be reached.

Example 2

A 100 gsm veil consisting of 92% 13 micron 6 mm glass and 8% PVA prebinder is formed using a wetlaid process using a foudrinier formed with inclined wire. This veil is fed to a belt dryer and dried and cured to form a prebonded sheet. The sheet is subsequently inline impregnated using a size press Foulard applicator with a binder/microsphere mixture consisting of 30% styrene acrylic (Necarbo SBN2039) and 70% microsphere (Expancel 054WU). The binder/microsphere mixture is controlled with a vacuum system and the target set at 35 gsm. The impregnated sheet is fed to an airfloat oven to dry the sheet and expand: the microspheres. Depending upon the speed, which was usually about 55 meters/minute, the temperatures used were between about 120° C. and 180° C. With these settings, an end product thickness from about 2.7 mm and a volume filling degree from about 30% can be reached.

Example 3

A 100 gsm veil consisting of 93% 13 micron 6 mm glass and 7% PVA prebinder is formed using a wetlaid process using a foudrinier formed with inclined wire. This veil is fed to a belt dryer and dried and cured to form a prebonded sheet. The sheet is subsequently inline impregnated using a size press Foulard applicator with a binder/microsphere mixture consisting of 30% styrene acrylic (Necarbo SBN2039) and 70% microsphere (Expancel 054WU). The binder/microsphere mixture is controlled with a vacuum system and the target set at 35 gsm. The impregnated sheet is fed to an airfloat oven to dry the sheet and expand: the microspheres. Depending upon the speed, which was usually about 55 meters/minute, the temperatures used were between about 120° C. and 180° C. With these settings, an end product thickness from about 4.1 mm and a volume filling degree from about 35% can be reached.

It is believed that Applicants' invention includes many other embodiments, which are not herein specifically described, accordingly this disclosure should not be read as being limited to the foregoing examples or preferred embodiments.

What is claimed is:

1. A method of making a microsphere-filled wet-laid veil comprising:

a) forming a non-woven fibrous veil;

b) forming an impregnation binder containing microspheres comprising a blowing agent; and c) impregnating said binder into said veil in a controlled manner to form a microsphere-filled wet-laid non-woven veil.

2. The method of claim 1, wherein said method further comprises heating the microsphere filled wet-laid veil to expand the microspheres.

3. The method of claim 1, wherein said microsphere-filled wet-laid veil is comprised of fibers selected from the group consisting of metal fibers, ceramic fibers, mineral fibers, glass fibers, carbon fibers, graphite fibers, polymer fibers, natural fibers, and combinations thereof.

4. The method of claim 1, wherein the step of forming a non-woven fibrous veil comprises the step of providing an aqueous slurry containing reinforcing fibers and a polyvinyl alcohol pre-binder.

5. The method of claim 1, wherein prior to said impregnation step, said microspheres are in an impregnation binder composition further comprising a binder selected from the group consisting of polyvinyl acetate, ethylene vinyl acetate/vinyl chloride copolymer, lower alkyl acrylate polymer, styrene-butadiene rubber, acrylonitrile polymer, polyurethane, epoxy resins, polymeric powders, polyvinyl chloride, polyvinylidene chloride, copolymers of vinylidene chloride with other monomers, partially hydrolyzed polyvinyl acetate, polyvinyl alcohol, polyvinyl pyrrolidone, polyester resins, and styrene acrylate copolymers.

6. The method of claim 5, wherein the impregnation binder composition optionally contains water, surfactants, foam stabilizers, thickeners, fillers, colorants, carbon black, hydrated alumina, blown silica, calcium carbonate, polymeric powders, or combinations thereof.

7. The method of claim 1, wherein said microspheres comprise a thermoplastic resin material selected from the group consisting of polystyrene, styrene copolymers, polyvinyl chloride, vinyl chloride copolymers, and vinylidene chloride copolymers.

8. The method of claim 1, wherein said blowing agent is selected from the group consisting of azodicarbonamide, isobutane, pentane, isopentane, and freon.

9. The method of claim 1, wherein prior to said impregnating step, the veil is pre-bonded with a pre-binder.

10. The method of claim 9, wherein said pre-binder is polyvinyl alcohol.

11. The method of claim 10, wherein the microspheres are impregnated into the veil with a Foulard applicator.

12. The method of claim 11, wherein the microspheres are impregnated into both sides of the veil with the Foulard applicator.

13. The method of claim 9, wherein the prebinder is added to an aqueous fiber slurry in the wet-end to form the non-woven fibrous veil.

14. The method of claim 9, wherein the prebinder is contacted with the veil using an applicator selected from the group consisting of a size press, a binder wire, rotary screen, dipping roll, spraying, and coating equipment.

* * * * *